US006068579A

United States Patent [19]

Killian et al.

[11] Patent Number: 6,068,579

[45] Date of Patent: May 30, 2000

[54] TREADMILL WITH A Y-SHAPED YOKE

[75] Inventors: Brian Killian; Cory Williamson, both of Bozeman, Mont.

[73] Assignee: Conetex, Inc., Elverson, Pa.

[21] Appl. No.: 09/295,638

[22] Filed: Apr. 20, 1999

[51] Int. Cl.[7] ..... A63B 22/02

[52] U.S. Cl. ..... 482/54; 482/51

[58] Field of Search ..... 482/51, 54

[56] References Cited

U.S. PATENT DOCUMENTS

| | | | |
|---|---|---|---|
| 5,518,471 | 5/1996 | Hettinger et al. | 482/54 |
| 5,743,833 | 4/1998 | Watterson et al. | 482/54 |
| 5,772,560 | 6/1998 | Watterson et al. | 482/54 |

*Primary Examiner*—Glenn E. Richman
*Attorney, Agent, or Firm*—Reed, Smith Shaw & McClay LLP

[57] ABSTRACT

The present invention discloses a treadmill apparatus having a rotatable treadmill frame which includes a right side, a left side, a front end, and a back end. The treadmill includes a lift motor which is connected to the front end of the treadmill frame. A lift arm is also included which has a first end and a second end and is connected to the lift motor. There is a "Y" shaped member having a one-pronged end and a two-pronged end. The one-pronged end is connected to the second end of the lift arm whereby the "Y" shaped lift arm is extended by a force supplied to the lift arm by the lift motor. The treadmill also includes a back axle support which has a first end and a second end and also has two attachment points. The attachment points are connected to the two-pronged end of the "Y" shaped member. The first end and second end of the back axle support are each connected to a swing arm, each swing arm being pivotly connected to the frame.

29 Claims, 4 Drawing Sheets

TREADMILL WITH A Y-SHAPED YOKE

BACKGROUND OF THE INVENTION

I. Field of the Invention

The present invention is directed generally to an exercise apparatus and more particularly, to a treadmill. Specifically, the present invention is directed to a treadmill which reduces vibrations transferred to a user.

II. Description of the Prior Art

Exercise is a necessary element for human health. Walking on a treadmill is a common element in an exercise routine. Such walking increases heart rate, thereby providing a cardiovascular workout, while simultaneously strengthening the muscles of the user. However, treadmills are often used in the home, rather than at the gym. It is desirable that such home treadmills be designed in such a way as to not mar a floor while in use.

In addition, a treadmill user may wish to change the inclination of the treadmill device to increase the difficulty of the workout. However, the ability to change the incline of a treadmill has in the past required a complex series of steps or even the detachment of parts.

Additionally, treadmills transfer vibrations to a user. Such vibrations are not only uncomfortable but annoying to a user. Such vibrations are unhealthy and can drain energy from the treadmill runner.

Therefore, the need exists for a treadmill that transfers minimal vibrations to a user, but may still be capable of having its angle of inclination varied with minimal effort.

SUMMARY OF THE INVENTION

In accordance with a preferred embodiment, the present invention discloses a treadmill apparatus having a rotatable treadmill frame which includes a right side, a left side, a front end, and a back end. The treadmill also includes a lift motor which is connected to the treadmill frame. A lift arm, (preferably a lift screw), has a first end and a second end and is coupled to the lift motor. Alternatively, the lift arm could be in a rack-n-pinion arrangement or a hydraulic arrangement. There is a "Y" shaped member having a one-pronged end and a two-pronged end. The one-pronged end is connected to the second end of the lift arm whereby the "Y" shaped member is extended by a force supplied to the lift arm by the lift motor. The treadmill also includes a back axle support which has a first end and a second end and also has two attachment points. The attachment points are connected to the two-pronged end of the "Y" shaped member. The first end and second end of the back axle support are each connected to a swing arm, each swing arm being pivotly connected to the frame.

In another preferred embodiment, the present invention of a treadmill device also includes a sub-frame which is connected to the frame of the treadmill.

DETAILED DESCRIPTION OF THE INVENTION

It is to be understood that the figures and descriptions of the present invention have been simplified to illustrate elements that are relevant for a clear understanding of the present invention, while eliminating, for purpose of clarity, many other elements found in a typical treadmill. Those of ordinary skill in the art will recognize that other elements are desirable and/or required in order to implement the present invention. However, because such elements are well known in the art, and because they do not facilitate a better understanding of the present invention, a discussion of such elements is not provided herein.

Figure 1:
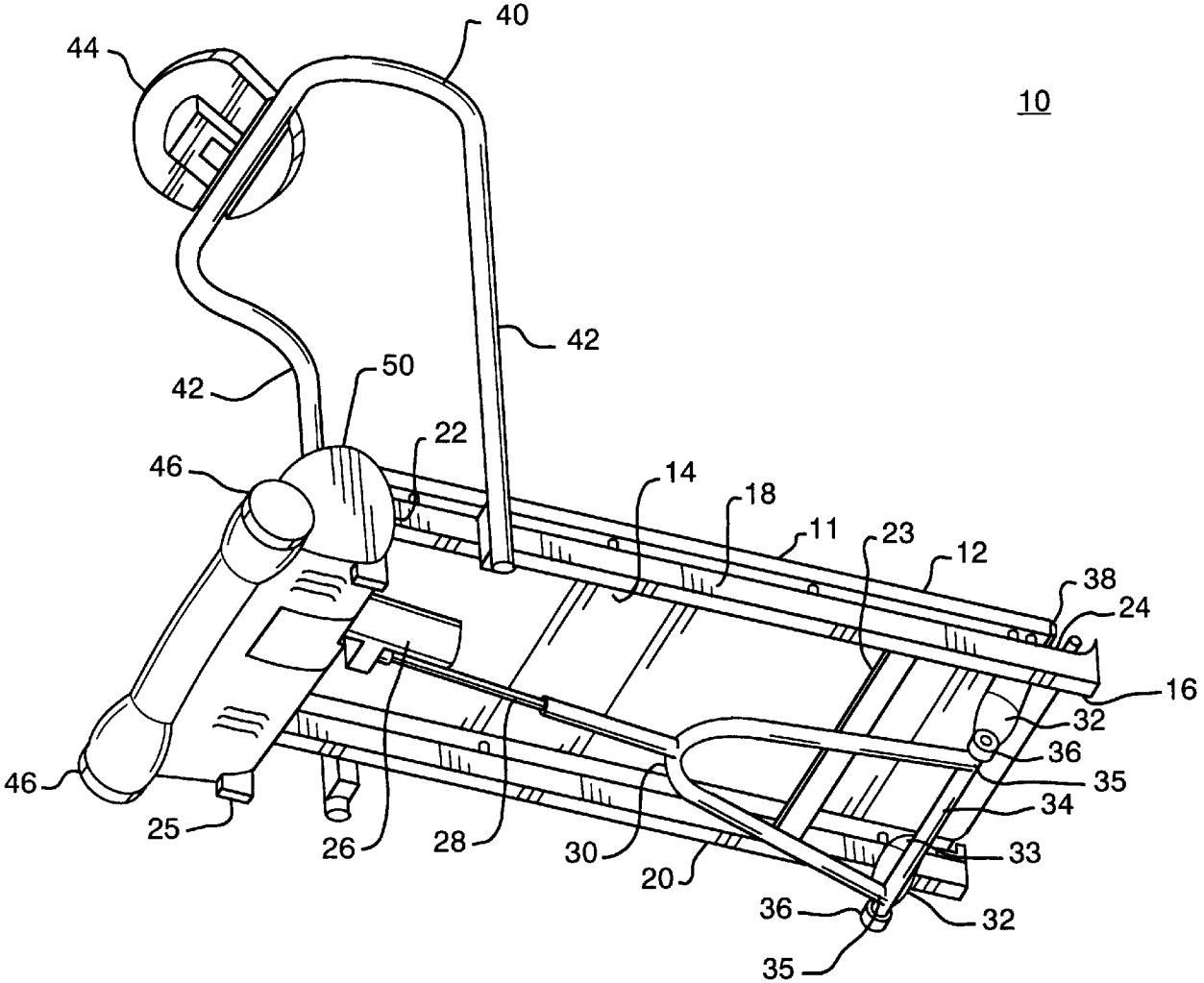
FIG. 1 is an isometric view of the treadmill device of the present invention.

Referring to FIG. 1, there is shown a treadmill device 10 having a belt 11 which includes a top surface 12 and a bottom surface 14. The treadmill device 10 also includes a frame 16 including a left side 18, a right side 20, a front end 22, and a back end 24. The treadmill frame 16 is of the type commonly used in the art. The belt 11 passes around the periphery of at least two rollers 38 in parallel alignment and having a horizontal axis of rotation. When the belt 11 is rolled around the rollers 38 either by the friction provided by the moving feet of a user, or by turning of the rollers 38 by a motor 50, the illusion of motion occurs while the user remains stationary. The continuous belt 11 is preferably constructed of material which is forgiving to the strike of the user's foot, and may include an impact cushion. For example, the belt 11 could be constructed of PVC or rubber. Connected to the frame 16 are supports 42 which are connected to a handle 40. The handle 40 is for the user to grasp in order to maintain balance while using the treadmill 10. The handle 40 can be fixed or pivotally mounted by methods well known in the art. Handle 40 also supports a display device 44. It will be obvious to one of ordinary skill in the art that other suitable handle and support arrangements would be apparent in view of this disclosure. The front end 22 of the frame 16 supports a pair of fulcrums or legs 25. A lift motor 26 is connected to the front end 22 of the treadmill frame 16. Of course, it would be obvious to one of ordinary skill in the art that the lift motor 26 could be arranged in other positions in view of the present disclosure. For example, the lift motor 26 could be mounted to a crossbar connected to the frame 16.

A lift arm, or in the case shown, lift screw 28 having a first end and a second end is turnably connected to the lift motor 26 at the first end and extending outwardly therefrom. ("The term "lifting arm" means, for the purpose of this application, a lift screw shown as element 28 in FIGS. 1, 2 and 4, or a rack-n-pinion arrangement or a hydraulic arrangement that provides a force similar to that of the lift screw). The lift screw 28 provides the connection to the lift motor 26 to allow the treadmill frame 16 to incline or be in a level position. The lift screw 28 is connected to the lift motor 26 in a manner which allows for the turning of the lift screw 28 by the lift motor 26. Once the degree of inclination is selected by the user or once the treadmill 10 is turned off, the lift screw 28 is locked in position until a new selection is made by the user. There is a "Y" shaped member or yoke 30 which has a one-pronged end and a two-pronged end. The one-pronged end is connected to the second end of said lift screw 28. In this arrangement, the "Y" shaped member 30 is extended or retracted by the turning of the lift screw 28. The extension of the "Y" shaped member 30 forces the back end 24 of the treadmill frame 16 upward when the length of the "Y" shaped member 30 extends beyond the length which can be accommodated by the length of the treadmill frame 16 while in an orientation parallel to the ground. A back axle support 34 having a first end and a second end and having two attachment points 35 is provided, wherein the attachment points 35 are connected to the two-pronged end of said "Y" shaped member 30. The first end and second end of the back axle support 34 are connected to swing arms 32, each swing arm 32 being pivotly connected to said frame 16. Back wheels 36 are also connected to each swing arm 32.

Also connected to the frame 16 is the treadmill motor 50 which drives the belt 11. Connected to the treadmill motor 50 are two front wheels 46. The frame 16 also includes at least one slat 23 to lend support to the frame 16. The "Y" shaped member or yoke 30 also gives additional support to the treadmill device 10 and thereby reduces the vibrations of the treadmill 10.

Figure 2:
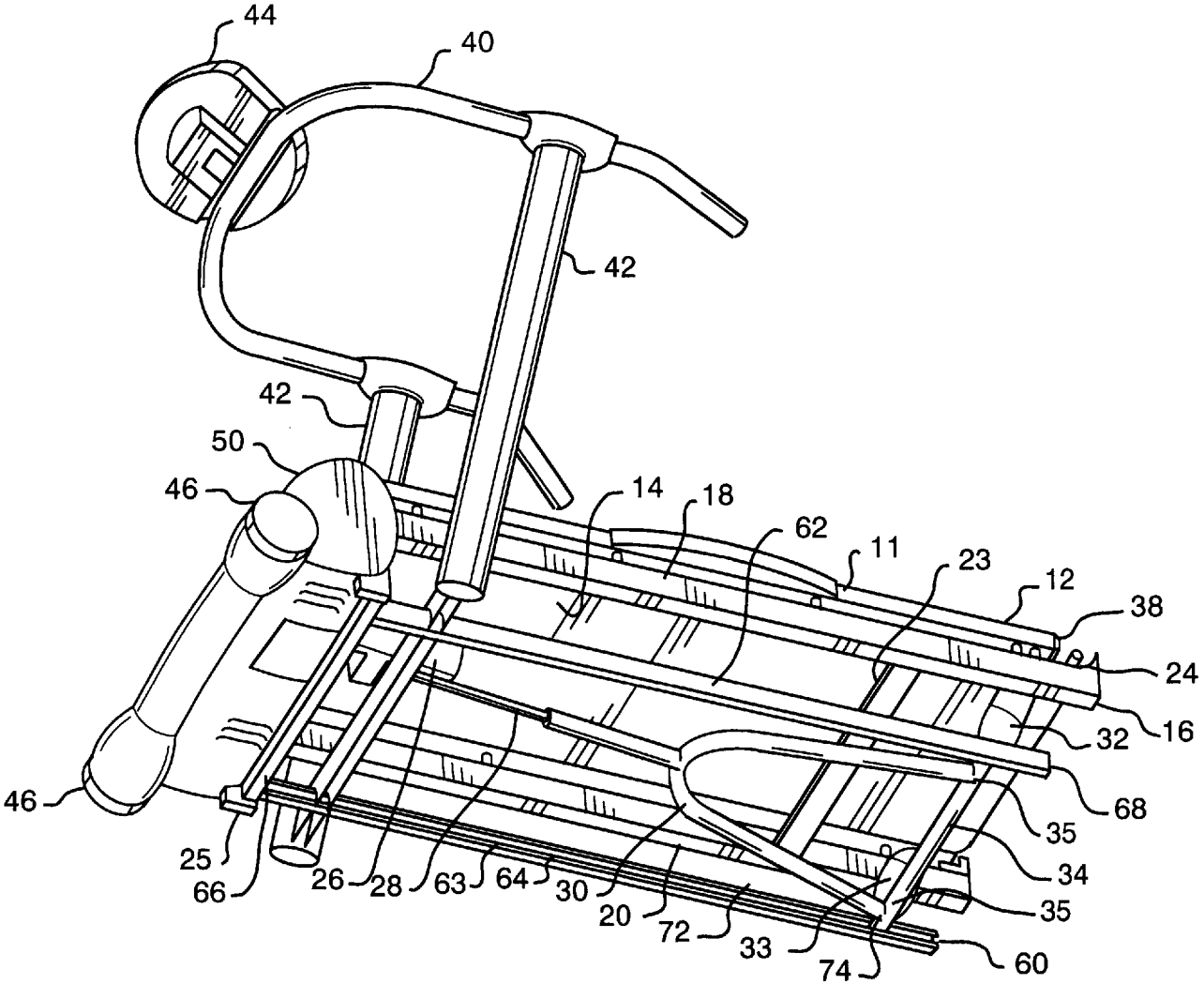
FIG. 2 is an isometric view of the treadmill device of the present invention including the sub-frame.

Referring to FIG. 2, there is shown a second preferred embodiment of the present invention. In the second preferred embodiment there is a sub-frame 60. The sub-frame 60 has a left side 62, a right side 64, and front and back ends 66 and 68 respectively. The left and right sides 62 and 64 both have a top portion and a bottom portion. In addition, both sides 62 and 64 have a groove 72 therein in order to accept nylon bushings 74. The groove 72 can be on either side or both sides of each left and right sides 62, 64 of sub-frame 60. This will be discussed further below. The sub-frame 60 helps to prevent marring of the floor upon which it rests, because the bottom sides of both the left and right sides 62,64 incorporate a nylon strip or coating 63. The coating 63 protects the floor from marring from movement of the treadmill 10. Though PVC is the preferred strip or coating used in the present invention, it would be obvious to one of ordinary skill in the art that any strip or coating could be used which protects the floor. Other examples may include Foam or Air Bladers.

In this embodiment, additional minimizing of vibrations is realized. In addition to the minimizing of vibrations to a user because of the "Y" shaped member or yoke 30, additional reduction in vibrations to a user is realized because of the placement of the supports 42. Note that in this embodiment the supports 42 are not attached to the frame 16, but rather are attached to the sub-frame 60. In this way, the vibrations produced by the treadmill motor 50 as it drives the belt 11 in a circular motion, is not directly transferred to the braces 42 by way of the frame 16. Since the braces 42 are connected to the sub-frame 60, the user will feel less vibration and will experience a more enjoyable workout.

Figure 3:
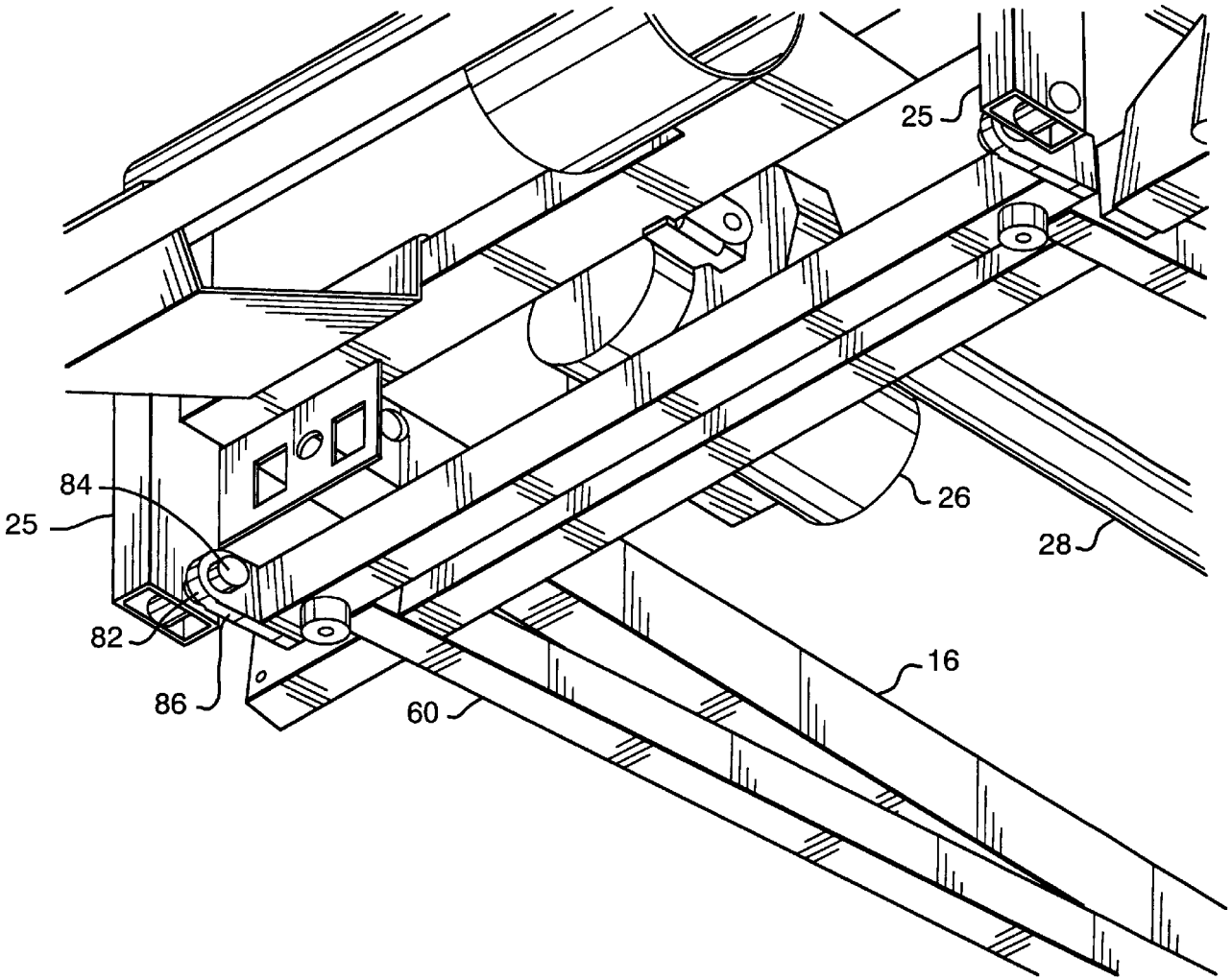
FIG. 3 is an isometric view illustrating the connection of the sub-frame to the frame of the present invention.

The attachment of the sub-frame 60 to the frame 16 will now be discussed. The front end 22 of the frame 16 has legs 25 connected thereto. The front end 66 of the sub-frame 60 is connected to the legs 25 in such a way as to give rotational movement to the sub-frame 60 relative to the frame 16. FIG. 3 shows but one way to attach the front end 22 of the frame 16 to the sub-frame 60. As shown, the legs 25 have a hole 82 through which a stud 84 is inserted. The stud 84 is also inserted through a shoulder bolt 86 that is attached to the sub-frame 60.

Although the front end 22 of the frame 16 and the front end 66 of the sub-frame 60 are depicted as being connected with the use of the shoulder bolt 86 and a stud 82, it will be obvious that there are many other arrangements which would be apparent to those skilled in the art in view of this disclosure.

In addition to the connection of the sub-frame 60 to the frame 16, the back axle support 34 is connected to the sub-frame 60 via the nylon bushings 74 and swing arms 32. These nylon bushings 74 are connected to the ends of the back axle support 34 in a manner well known in the art. The bushings 74 are then inserted into the grooves 72 in both the left and right sides 62,64 of the sub-frame 60. As the lift motor 26 begins to turn the lift screw 28 the "Y" shaped member 30 can be extended or retracted as the nylon bushings 74 slide within the grooves 72 provided on the left and right sides 62, 64 of sub-frame 60. Although the bushings 74 are described as nylon and that such bushings slide within a groove 72, other structural components could be used instead. For example, a wheel and track arrangement could be used wherein either or both of the track could have a neoprene coating or the like for ease of movement. Other suitable arrangements would also likewise be apparent to those skilled in the art in view of this disclosure. For example, the left and right sides 62, 64 of sub-frame 60 can be tubular and the back axle support 34 can have ends forming a loop. The left and right sides 62, 64 can be inserted through the loop ends of the back axle support 34. In this way, the back axle support 34 can slide along the left and right sides, 62, 64 of sub-frame 60.

The swing arms 32 provide for the connection of the "Y" shaped member 30 to the treadmill frame 16, as well as help in controlling the angle of inclination of the treadmill frame 16 with respect to the ground or sub-frame 60.

Figure 4:
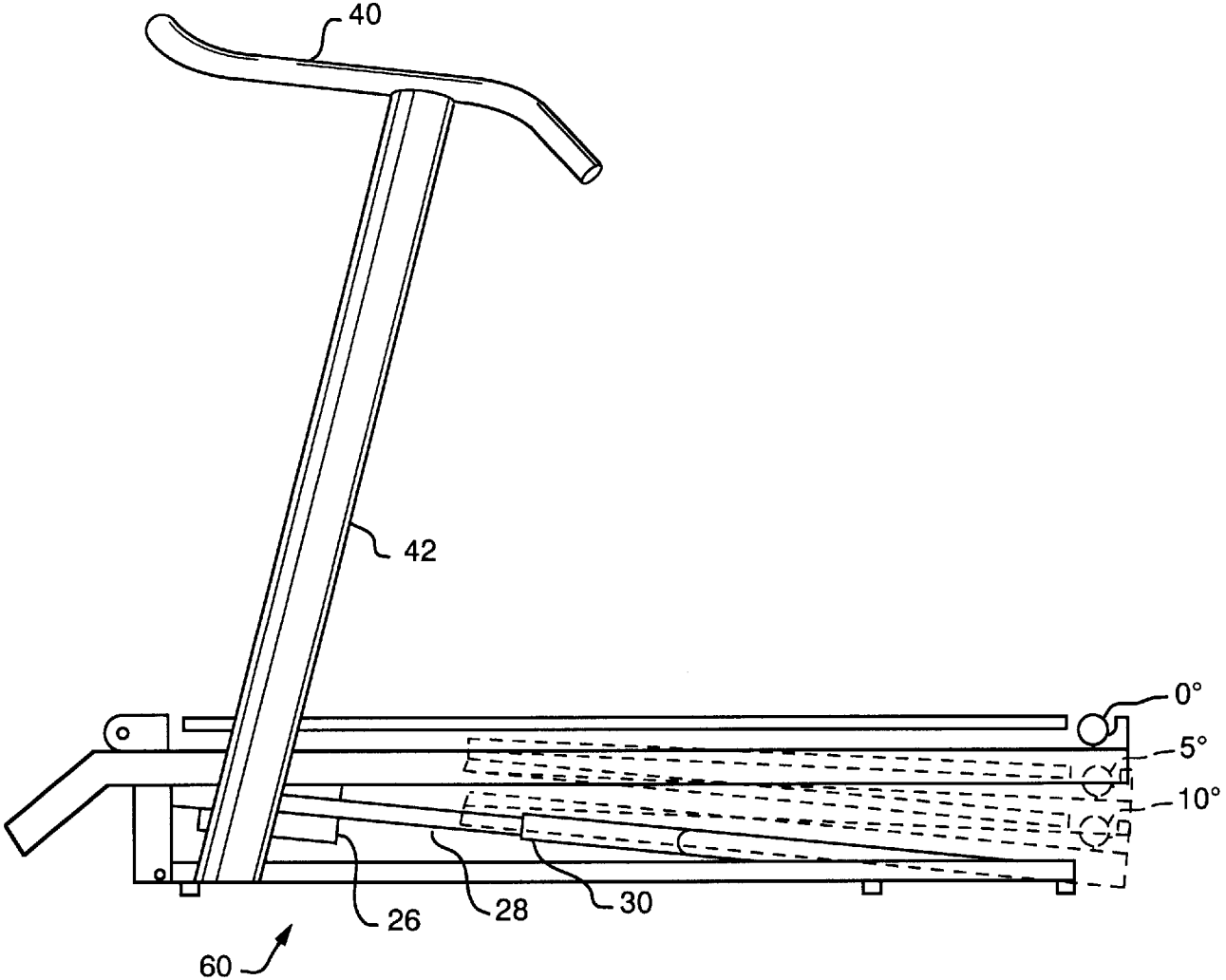
FIG. 4 is an isometric view illustrating the treadmill of the present invention in an upward inclined position.

Referring now to FIG. 4, the treadmill 10 is shown as the back end 24 of the frame 16 travels from 0 degrees to an incline of 10 degrees. This gives a user the sensation of running up an incline or hill and therefore, a more vigorous workout. The treadmill 10 can also be inclined is such a way as to give a runner the sensation of running down an incline or hill. In other words, the treadmill has three general positions by having the back end level, back end inclined up or back end inclined down. It is noted that the swinging arms 32 help in controlling the angular orientation or incline of the treadmill frame 16 with respect to the floor or sub-frame 60. The user can select the desired grade by touching the appropriate icon on the display device 44. The desired grade could also be changed by having the user twist a twist knob or slide a lever in the appropriate direction.

Therefore, a treadmill device 10 has been described which transfers less vibration to a user than those treadmill devices presently available. The reduction of vibrations is primarily because of the unique "Y" shaped member 30 and the placement of the braces 42, which is connected to the handle 40, on the sub-frame 60.

It would be appreciated by those skilled in the art that changes could be made to the embodiment described above without departing from the broad inventive concept thereof. It should be understood, that this invention is not limited to the particular embodiment disclosed, but is intended to cover all modifications which are within the spirit and scope of the invention as defined by the appended claims.

What is claimed:

1. A treadmill comprising:

(a) a rotatable treadmill frame having a right side, a left side, a front end and a back end;

(b) a lift motor connected to said treadmill frame;

(c) a lift arm having a first end and a second end, said lift arm being coupled to said lift motor at said first end and extending outwardly therefrom;

(d) a "Y" shaped member having a one-pronged end and a two-pronged end, said one-pronged end connected to said second end of said lift arm, whereby said "Y" shaped member is extended by turning of said lift arm by the lift motor;

(e) a back axle support having a first end and a second end and having two attachment points thereon, said attachment points being connected to said two-pronged end of said "Y" shaped member, said first end and second end of said back axle support being connected to a swing arm, each swing arm being pivotly connected to said frame.

2. The treadmill of claim 1, wherein said treadmill includes a pair of supports having a first end and a second end, said pair of supports being connected at said second end to said frame.

3. The treadmill of claim 2, wherein a "U" shaped handle is connected to said supports at said first end.

4. The treadmill of claim 3, wherein an electronic display is connected to said "U" shaped handle.

5. The treadmill of claim 3, wherein said front end of said frame has a pair of fulcrums connected thereto.

6. The treadmill of claim 5, wherein said pair of fulcrums are legs.

7. The treadmill of claim 1, wherein a sub-frame is connected to said frame.

8. The treadmill of claim 7, wherein said sub-frame includes a right side, a left side, a front end, and a back end.

9. The treadmill of claim 8, wherein each said left side and right side of said sub-frame contains a groove.

10. The treadmill of claim 8, wherein each said left side and right side of said sub-frame has a nylon coating thereon.

11. The treadmill of claim 9, wherein each said first and second ends of said back axle support contains a bushing.

12. The treadmill of claim 11, wherein said bushings connected to said first and second ends of said back axle support slide within said groove contained in each said right side and left side of said sub-frame as said lift motor turns to extend and/or retract said lift arm.

13. The treadmill of claim 7, wherein a pair of supports having a first end and a second end, said pair supports being connected at said second end to said sub-frame.

14. The treadmill of claim 13, wherein a "U" shaped handle is connected to said supports at said first end.

15. The treadmill of claim 14, wherein an electric display is connected to said "U" shaped handle.

16. The treadmill of claim 15, wherein said front end of said frame has a pair of fulcrums connected thereto.

17. The treadmill of claim 16, wherein said pair of fulcrums are legs.

18. The treadmill of claim 1, wherein said treadmill can be inclined in at least three general positions including back end level, back end inclined down and back end inclined up.

19. The treadmill of claim 1, wherein the lift arm is a lift screw turnably connected to the lift motor.

20. A treadmill comprising:

(a) a treadmill frame; a sub-frame connected to said frame;

(b) a lift motor connected to said treadmill frame;

(c) a lift arm having a first end and a second end, said lift arm being coupled to said lift motor and said first end, and extending outwardly therefrom;

(d) a "Y" shaped member having a one-pronged end and a two-pronged end, said one-pronged end connected to said second end of said lift arm, whereby said "Y" shaped member is extended by a force supplied to said lift arm by the lift motor;

(e) a back axle support having a first end and a second end and having two attachment points thereon, said attachment points being connected to said two-pronged end of said "Y" shaped member, said first end and second end of said back axle support being connected to a swing arm, each swing arm being pivotly connected to said frame.

21. The treadmill of claim 20, wherein said sub-frame has a front end, a back end, a left side and a right side.

22. The treadmill of claim 21, wherein said left and right sides of said sub-frame have a nylon coating thereon.

23. The treadmill of claim 21, wherein said left and right sides of said sub-frame have grooves therein.

24. The treadmill of claim 23, wherein said back axle support is connected at said first end and said second end to bushings which slides in said grooves of said right and left sides of said sub-frame.

25. The treadmill of claim 20, wherein connected to said sub-frame is a pair of supports having a first end and a second end, said pair of braces being connected at said second end to said sub-frame.

26. The treadmill of claim 25, wherein a "U" shaped handle is connected to said supports at said first end.

27. The treadmill of claim 26, wherein an electronic display is connected to said "U" shaped handle.

28. The treadmill of claim 20, wherein said treadmill can be inclined between 0 and 10 degrees.

29. The treadmill of claim 20, wherein the lift arm is a lift screw turnably connected to the lift motor.

* * * * *